United States Patent [19]

Zeigler

[11] Patent Number: 4,800,663

[45] Date of Patent: Jan. 31, 1989

[54] COLLAPSIBLE DISPLAY APPARATUS

[76] Inventor: Theodore R. Zeigler, 205 S. Columbus St., Alexandria, Va. 22314

[21] Appl. No.: 941,486

[22] Filed: Dec. 11, 1986

[51] Int. Cl.[4] ..... G09F 15/00

[52] U.S. Cl. ..... 40/610; 40/606; 40/617

[58] Field of Search ..... 40/610, 606, 607, 617, 40/605

[56] References Cited

U.S. PATENT DOCUMENTS 4,001,987 1/1977 Coulhard ..... 40/610

4,471,548 9/1984 Goudie ..... 40/610

4,512,097 4/1985 Ziegler ..... 40/610

4,658,560 4/1987 Beaulieu ..... 40/610

*Primary Examiner*—Gene Mancene

*Assistant Examiner*—Wenceslao J. Contreras

[57] ABSTRACT

Display apparatus of expandable/collapsible form incorporating a framework which is erected and display support mounted on the framework defining a continuous support surface to which displays may be attached. A feature of the framework includes mounting for auxiliary devices and which functions to hold the framework in erected condition.

39 Claims, 3 Drawing Sheets

COLLAPSIBLE DISPLAY APPARATUS

BACKGROUND OF THE INVENTION

This invention relates to a collapsible apparatus incorporating one or more collapsible modules which may be self-locking or self-supporting when in expanded erected position or which may be of the type employing manually operated means for retaining the module in erected position. The modules may conform to the subject matter of my prior U.S. Pat. Nos. 3,968,808; 4,026,313; 4,280,521; 4,290,244; 4,437,275; and 4,473,986 or to that of Derus U.S. Pat. No. 31,641. The modules may also be of the type disclosed in my copending application Ser. No. 656,937, filed Oct. 2, 1984, the subject matter of which is incorporated herein by reference thereto, and which is a continuation-in-part of my prior U.S. Pat. No. 4,473,986, the subject matter of which is also incorporated herein by reference thereto.

The invention relates to a display apparatus of the type used as a portable exhibit which provides a relatively large display area. Such apparatus can be employed at trade shows, conventions, seminars and the like. The apparatus must be of lightweight construction and be foldable into a compact arrangement which is readily carried. It must be capable of being quickly and easily erected or collapsed while providing a sturdy and stable structure when erected.

In prior art structures, the displays are on separate panels or strips of material mounted on the framework. These separate panels or strips produce unsightly seams therebetween which severely detract from the appearance of the display.

It is important to provide a construction whereby all of the components may be packed into a carrying case which is suitable for carrying aboard an aircrat or the like so that the apparatus may be readily transported from one place to another.

It is often desirable to mount illumination means on the apparatus to suitably light up the supported display, and it is further desirable to provide means for retaining the apparatus in its erected position.

BRIEF SUMMARY OF THE INVENTION

The invention is directed to an apparatus especially adapted to be used as a tabletop display and which includes a pair of adjacent modules each of which has a plurality of interconnected strut means and hub means collapsible into an arrangement wherein the strut means are substantially parallel to one another and certain hub means are adjacent one another. In the expanded erected position, these hub means of each module are widely spaced and lie in a substantially planar rectangular array defining a face of the associated module.

Rigid connecting means is interconnected between pairs of hub means on each module through the intermediary of clip means. This connecting means serves to retain the apparatus in erected position. The clip means and connecting means can be easily snapped into and out of operative relationship to facilitate assembly and disassembly of the apparatus. A pivotal interconnection is provided between the clip means and connecting means to enable the connecting means to be effectively snapped into operative position even if the associated hub means do not lie precisely in a planar array.

Attaching means is carried by both the clip means and connecting means and cooperates with suitable display support means. The connecting means accordingly may serve a dual function in serving to support attaching means for attaching display support means to the framework and also providing a means for retaining the apparatus in erected position.

The display supporrt means defines a substantially continuous support surface and comprises a single sheet of material to which a display may be attached by pressing the display into engagement with the support surface and detached by pulling the display away from the support surface. The display support means serves to effectively cover the faces of the two modules with a seamless surface and furthermore wraps around the ends of the modules to present a neat and pleasing appearance to an observer wherein the framework is substantially hidden from view. This type of display support means enables displays to be readily attached to and detached from the display support means.

Certain hub means are provided with mounting openings for receiving portions of mounting members connected to an auxiliary device in the form of an illuminating lamp whereby the lamp is adjustably supported at the top of the apparatus for illumiinating the display. The illuminating means is accordingly adequately supported in a most simple and effective manner. The mounting means of the auxiliary device also prevents movement of the associated hub means away from one another thereby retaining the apparatus in its erected position.

The apparatus has a dimension of one module in height and a plurality of modules in width which collapses into a bundle having a lengthwise dimension slightly greater than the height of the apparatus in its erected position. The display support means has a height approximating the height of one erected module, the length of the display support means being considerably greater than the height thereof and somewhat greater than the length of the erected apparatus.

The display support means is sufficiently flexible such that it may be coiled up into a cylindrical form having a length somewhat less than the folded bundle. Accordingly, the coiled display support means may be disposed in surrounding relation to the bundle, and these components then may be placed into a cylindrical carrying case of slightly greater length than the folded bundle.

BRIEF DESCRIPTION OF THE DRAWING FIGURES

DETAILED DESCRIPTION OF THE INVENTION

Figure 1:
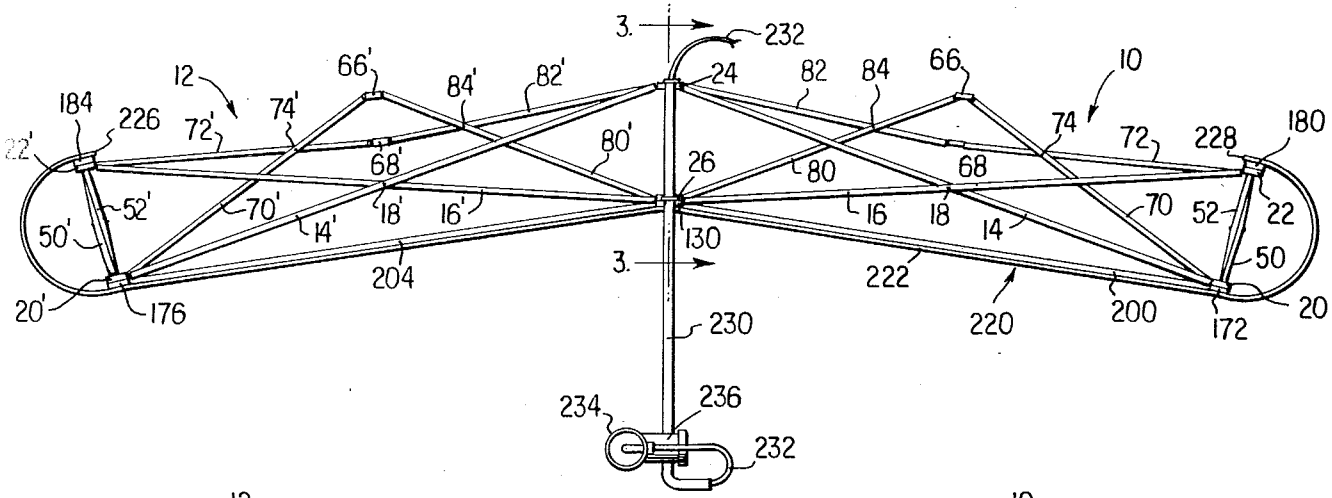
FIG. 1 is a top view of the erected display apparatus according to the invention.
Figure 2:
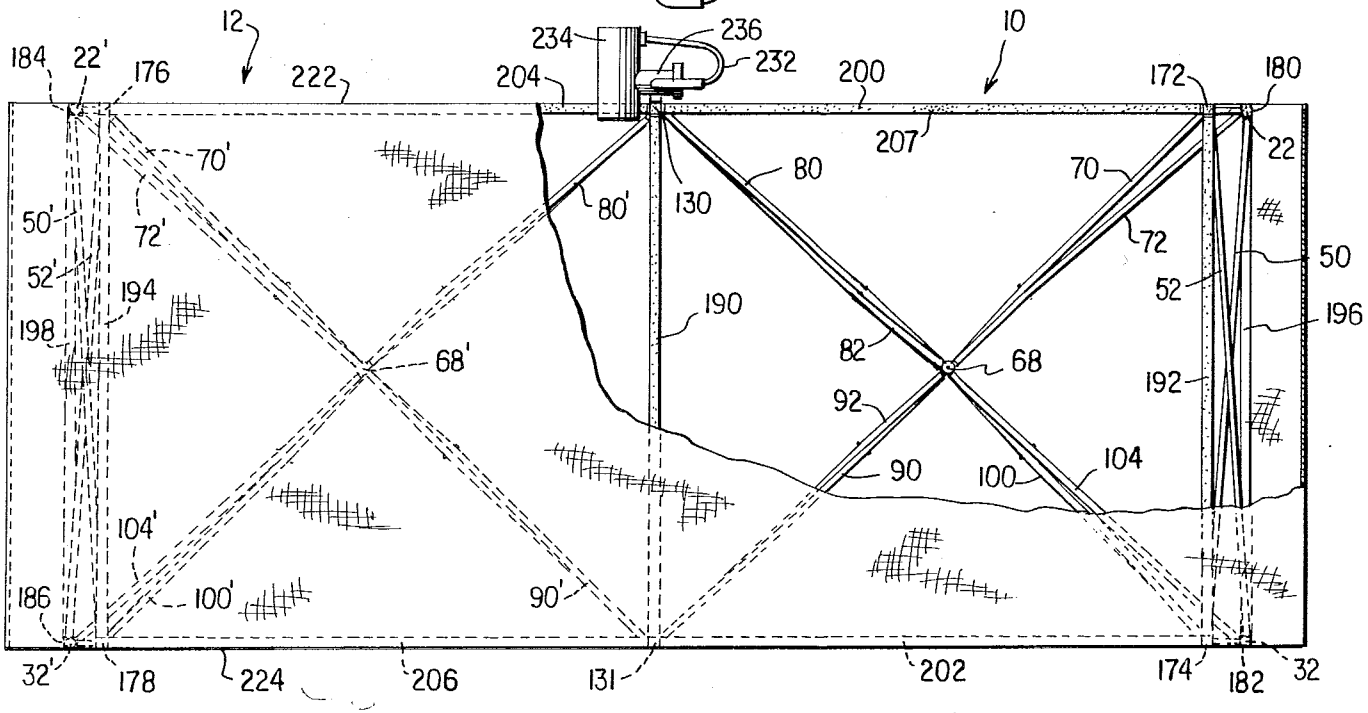
FIG. 2 is a front view partly broken away of the apparatus shown in FIG. 1.

Referring now to the drawings wherein like reference characters designate corresponding parts throughout the several views, there is shown in FIGS. 1 and 2 overall views of a collapsible display apparatus according to the present invention. While the apparatus is particularly adapted to be used for display purposes, it is evident that the structure can also be employed for other purposes such as a portable partition or the like. The apparatus is disclosed as comprising a pair of adjacent similar modules 10 and 12 each of which is of a construction as disclosed in the aforementioned patents and patent application. The display apparatus may also comprise a single module or more than two modules, depending on the size of the display. Two modules form an apparatus of appropriate size to be placed on a table, the modules in a typical example having display faces about thirty one inches in width and thirty two inches in height. It is apparent that the actual size of the modules and the complete apparatus may be varied within wide limits as desired.

The modules are illustrated as being of the self-locking or self-supporting type, but modules which employ manually operated means for retaining the modules in erected position may also be employed. The modules are shown in the expanded erected position and are of similar construction, the two modules being mirror images of one another and sharing certain common parts as hereinafter described. Module 10 will be specifically described corresponding parts of module 12 being given the same reference numerals primed.

Figure 3:
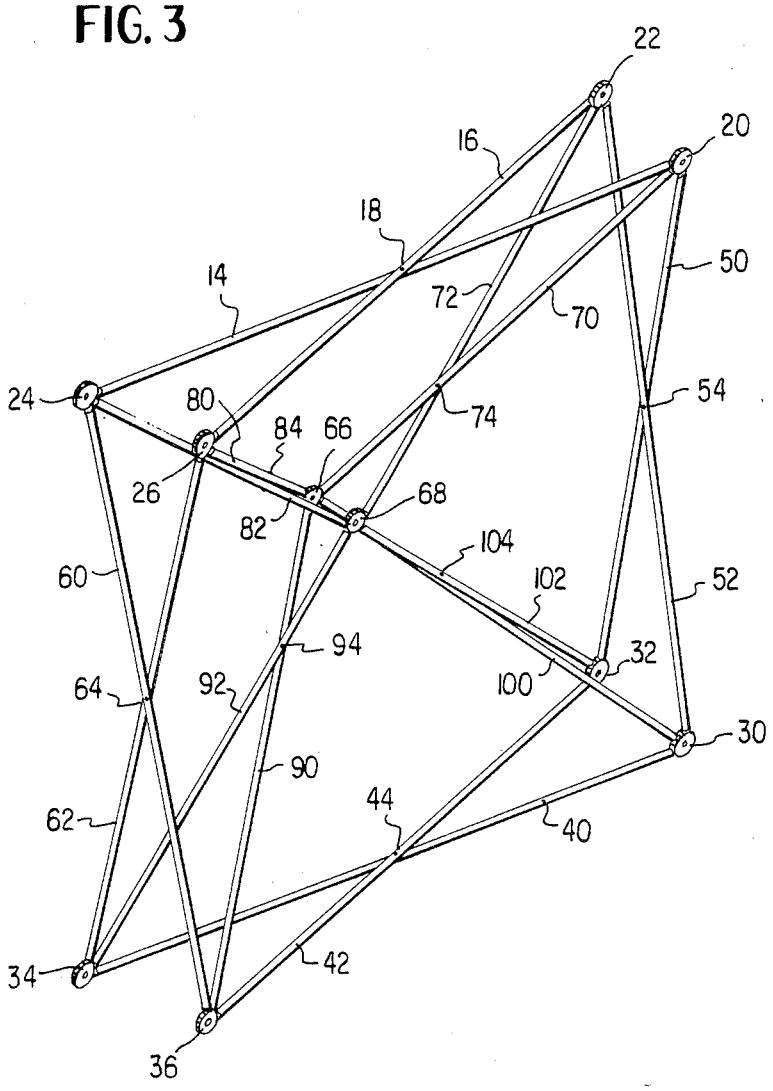
FIG. 3 is a top perspective view of a single module of the apparatus.

The modules are formed of a plurality of pivotally interconnected struts which are of lightweight yet strong construction and may for example comprise lengths of aluminum tubing, the struts also being pivotally interconnected with hubs which may be formed of plastic or the like. As seen most clearly in FIG. 3 of the drawings, module 10 includes a pair of struts 14 and 16 at the top thereof, these struts being pivotally connected to one another at 18 by a rivet or any suitable pivot means. Four hubs 20, 22, 24 and 26 are provided at the the top of module 10, hubs 20 and 22 being substantially identical with the hubs disclosed in U.S. Pat. No. 4,280,521, and hubs 24 and 26 being of slightly different construction as hereinafter described. Strut 14 has the opposite ends thereof pivotally interconnected with hubs 20 and 24, and strut 16 has the opposite ends thereof pivotally interconnected with hubs 22 and 26.

Four additional hubs 30, 32, 34 and 36 are provided, hubs 20, 26, 30 and 36 being disposed in a substantially planar rectangular array to define one face of the module, hubs 22, 24, 32 and 34 being disposed in a substantially planar rectangular array to define an opposite face of the module. A pair of struts 40 and 42 are pivotally connected to on another at 44. Strut 40 has its opposite ends pivotally interconnected with hubs 30 and 34, and strut 42 has its opposite ends pivotally interconnected with hubs 32 and 36

A pair of struts 50 and 52 are pivotally interconnected with one another at 54. Strut 50 has the opposite ends thereof pivotally interconnected with hubs 20 and 32, and strut 52 has the opposite ends thereof pivotally interconnected with hubs 22 and 30. Hubs 20, 22, 30 and 32 and struts 50 and 52 pivotally interconnected therewith define an end of the module.

A pair of struts 60 and 62 are pivotally interconnected with one another at 64. Strut 60 has the opposite ends thereof pivotally interconnected with hubs 24 and 36, and strut 6 has the opposite ends thereof pivotally interconnected with hubs 26 and 34. Hubs 24, 26, 34, 36 and struts 60, 62 are common to both modules 10 and 12.

A further pair of hubs 66 and 68 are provided. A pair of struts 70 and 72 are pivotally interconnected with one another at 74. Strut 70 has the opposite ends thereof pivotally interconnected with hubs 20 and 66, and strut 72 has the opposite ends thereof pivotally interconnected with hubs 22 and 68. A pair of struts 80 and 82 are pivotally interconnected with one another at 84. Strut 80 has the opposite ends thereof pivotally interconnected with hubs 26 and 66, and strut 82 has the opposite ends thereof pivotally interconnected with hubs 24 and 68.

A pair of struts 90 and 92 are pivotally interconnected with one another at 94. Strut 90 has the opposite ends thereof pivotally interconnected with hubs 36 and 66, and strut 92 has the opposite ends thereof pivotally interconnected with hubs 34 and 68. A further pair of struts 100 and 102 are pivotally interconnected with one another at 104. Strut 100 has the opposite ends thereof pivotally interconnected with hubs 30 and 66, and strut 102 has the opposite ends thereof pivotally interconnected with hubs 32 and 68.

Referring now to FIG. 1 of the drawing, it is apparent that module 12 is a mirror image of module 10, the two modules having common struts and hubs as aforedescribed. The common hubs 26, 36 and the hub 20' as well as the hub on module 12 corresponding to hub 30 of module 10 also are disposed in a substantially planar rectangular array to define a face of the module 12, the opposite face of the module being defined in the same manner as described in connection with module 10. The struts 50' and 52' and the pivotally interconnected hubs define an end of module 12. The two modules are of self-locking or self-supporting construction.

Figure 4:
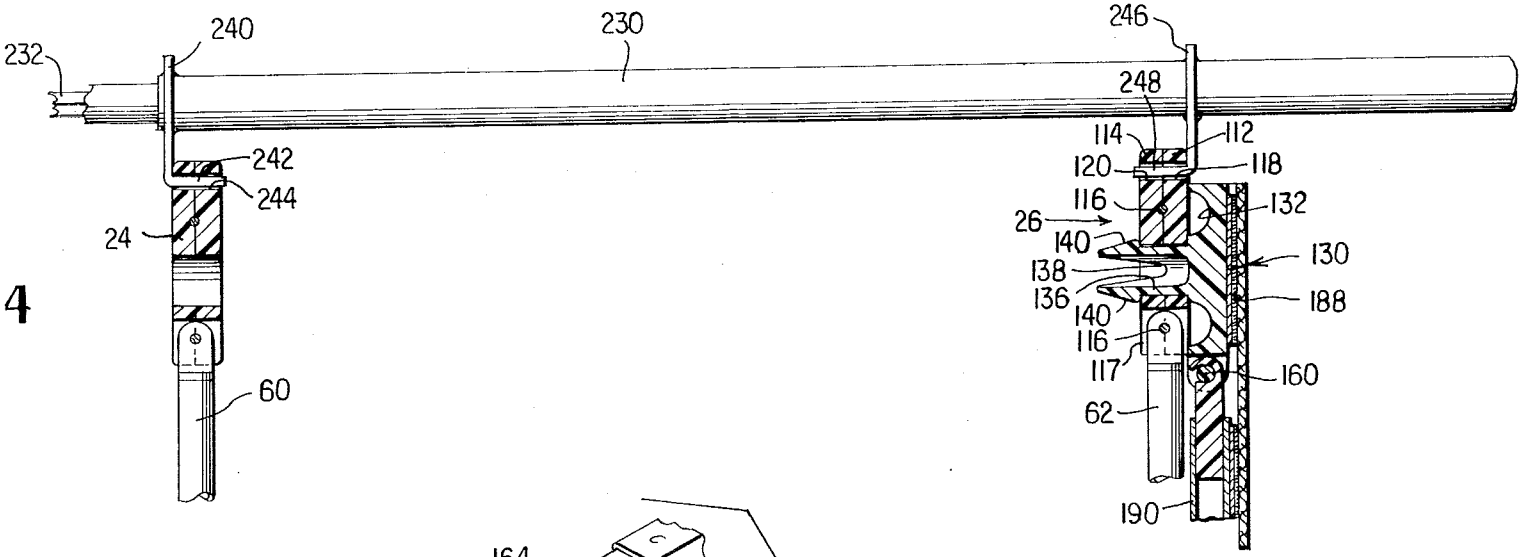
FIG. 4 is a sectional view on an enlarged scale taken along line 4—4 of FIG. 1 looking in the direction of the arrows.
Figure 5:
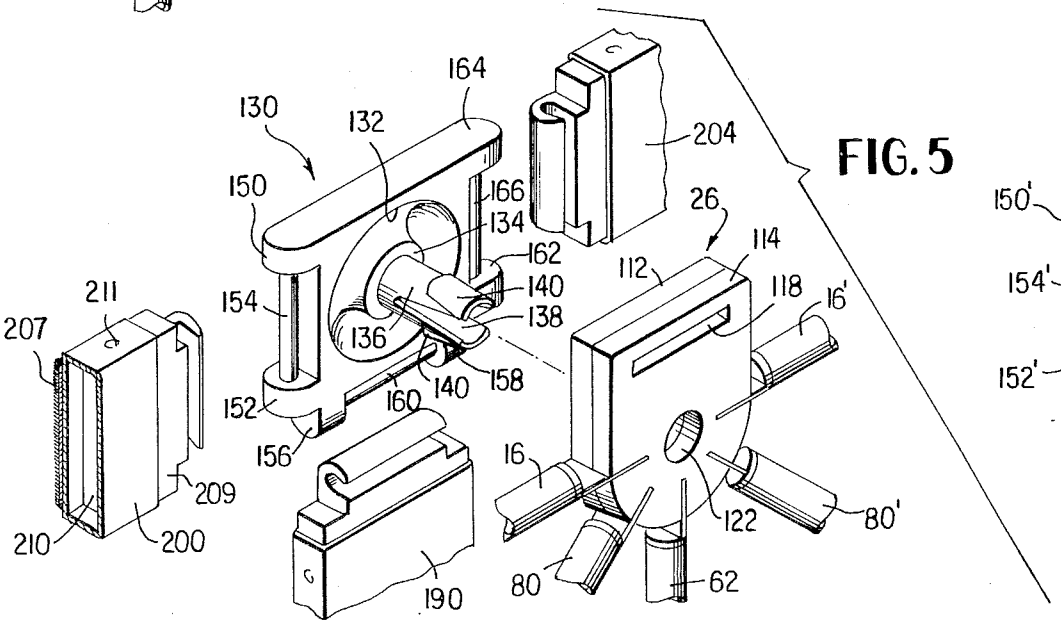
FIG. 5 is an exploded perspective view showing cooperating portions of a hub means, a clip means and connecting means associated therewith.

Referring now to FIGS. 4 and 5 of the drawings, hub 26, which is identical in construction with hub 24, is formed slightly differently from the hubs disclosed in U.S. Pat. No. 4,280,521, although it employs the same general principles. The hub is formed of plastic and comprises a pair of flat members 112 and 114 which are adhesively secured to one another. A wire 116 lies within a groove defined by recesses formed in abutting faces of the members, this wire passing through suitable holes provided in the flattened ends of the associated struts to pivotally interconnect the struts with the hub. The flattened ends of the struts are received within suitable recesses provided in the hub, such as indicated by reference numeral 117. A pair of holes in the form of aligned elongated slots 118 and 120 are provided through upper portions of members 112 and 114 respectively for a purpose hereinafter described. A central circular hole 122 is formed through the hub for securing a clip thereto. All of the other hubs are likewise provided with such a central hole.

A clip is indicated generally by reference numeral 130 and is formed of plastic or similar material. A recess 132 is formed in one face of the clip and a central portion 134 of the clip includes an integral tubular portion 136 extending therefrom. A pair of V-shaped cutouts 138 are provided at opposite sides of tubular portion 136 such that the outer end of the tubular portion will be flexible. A pair of outwardly extending lugs 140 are formed at the opposite sides on the outer end of the tubular portion. This construction is such that the outer ends of the tubular portion may be squeezed together and inserted through the central hole in one of the clips whereupon the outer ends of the tubular portion will snap outwardly into the position shown in FIG. 4 so that the lugs 140 retain the clip in position. When it is desired to remove the clip, the outer ends of the tubular portion may again be squeezed together, and the tubular portion may be removed through the central hole of the associated hub.

The clip is shown as a four sided member, and a first pair of spaced ears 150 and 152 are formed at one side of the member, a cylindrical pivot pin 154 extending between such ears and being spaced from the adjacent side of the clip. A second pair of spaced ears 156 and 158 are formed at a second side of the clip, a cylindrical pivot pin 160 extending between such ears and being spaced from the adjacent side of the clip. A third pair of spaced ears 162 and 164 are similarly provided at a third side of the clip with a cylindrical pivot pin 166 extending between these ears and being spaced from the adjacent side of the clip. As seen in FIG. 2, clip 130 is mounted at the upper central portion of the apparatus, a similar clip 131 being provided at the lower portion of the apparatus. These clips have pivot pins on three sides thereof, whereas the remaining clips may have pivot pins on only one or two sides thereof as will become apparent.

As seen in FIGS. 1 and 2, similar clips 172, 174, 176 and 178 are secured respectively to hubs 20, 30, 20' and the hub on module 12 corresponding to hub 30. Each of these clips may have pivot pins formed on only two sides thereof if desired. Further similar clips 180, 182, 184 and 186 are secured to hubs 22, 32, 22' and 32' respectively. Such further clips may have pivot pins formed on only one side thereof if desired.

Each of the clips is provided with attaching means for attaching display means thereto. As seen in FIG. 4, clip 130 has a sheet of material 188 adhesively secured to the outwardly facing flat surface thereof, this material being preferably of the hook and loop type commonly known as VELCRO which is adapted to be attached to cooperating material by pressing the two materials together and detached by simply pulling the two materials apart. All of the clips are likewise provided with such attaching means on the outwardly facing surface thereof.

A plurality of rigid connecting means are provided in the form of lightweight aluminum hollow bars which are interconnected between pairs of hubs by being connected to the clips secured to the associated hubs. A first vertically extending connecting bar 190 has the opposite ends thereof connected to clips 130 and 131. Similar vertically extending connecting bars 192 and 194 are connected between clips 172, 174 and 176, 178 respectively at opposite ends of the two modules. Further vertically extending connecting bars 196 and 198 are connected between clips 180, 182 and 184, 186 respectively on the opposite faces of modules 10 and 12.

A pair of horizontally extending connecting bars 200 and 202 are connected between clips 130, 172 and 131, 174 respectively on module 10. A further pair of horizontally extending connecting bars 204 and 206 are connected between clips 130, 176 and 131, 178 respectively on module 12.

It will be noted that the connecting bars are disposed along peripheral portions of the faces of the modules 10 and 12 and provide an effective arrangement for attaching display support means as will be further described. Each of the connecting bars is connected at each end thereof to the pivot pin of one of the clips, and accordingly, it will be apparent that while clips 130 and 131 must have pivot pins on at least three sides thereof, clips 172, 174, 176 and 178 may have pivot pins on only two sides thereof, while clips 180, 182, 184 and 186 may have pivot pins on only one side thereof if so desired.

Figure 6:
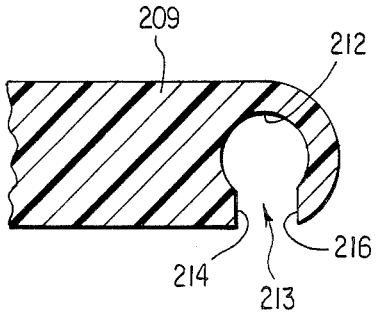
FIG. 6 is a sectional view through the end portion of one of the connecting means illustrating the details of construction thereof.
Figure 7:
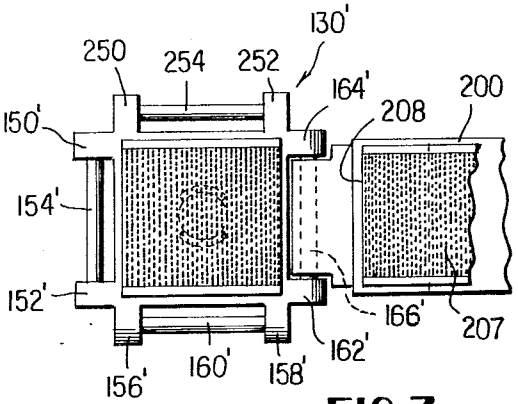
FIG. 7 is a front view of a modified form of clip means and a connecting means operatively connected therewith.

All of the connecting bars are of substantially the same construction, although the length thereof may vary. Accordingly, a description of the construction of one of the connecting bars will suffice for all of them. As seen in FIGS. 5–7, connecting bar 200 is of tubular construction having a rectangular cross-sectional configuration. A strip of attaching material 207 similar to the attaching material on the clips is secured as by adhesive to one face of the connecting bar for attaching display means thereto. This strip of attaching material extends along the length of the bar and terminates at 208 just short of the end thereof as can be seen in FIG. 7 wherein the bar is shown connected to a modified clip hereinafter described.

Referring again to FIGS. 5–7, bar 202 includes a pair of identical plastic end portions 209 each of which has a part 210 thereof snugly received within the hollow tubular aluminum portion of the bar and held in place by suitable means such as crimping as indicated at 211. The plastic end portion includes a recessed portion or groove for receiving the pivot pin of one of the clips, the groove including a seat portion 212 which is of a configuration to snugly receive one of the pivot pins. The groove includes a reduced entrance portion indicated generally by reference character 213 which is defined between opposite parallel flat surfaces 214 and 216 formed on the plastic end portion. The outer part of the plastic end portion is flexible so that surface 216 may move away from surface 214 when a pivot pin is inserted in the groove. When the pin is seated in portion 212, the surface 216 can snap back into the position illustrated to hold the pivot pin in place. This snap action arrangement ensures that the connecting bar remains connected to the associated clip until it is desired to force the pivot pin out of the groove and disengage the connecting bar from the clip.

It is apparent that each of the connecting bars has the opposite ends thereof connected to an associated clip by the interengagement of a pivot pin on the clip with the groove formed in the associated end of the connecting bar, and since the clips are interconnected with one of the hubs, the connecting bars are accordingly interconnected at the opposite ends thereof with a pair of hubs. The pivot pin and groove construction is such that the connecting bars are pivotally connected with the associated clips and hubs. This pivotal interconnection permits the connecting bars to be effectively connected with various hubs even though the hubs are not precisely in a planar array. In other words, the pivotal interconnection compensates for any misalignment of the hubs with respect to one another.

When the connecting bars are interconnected with the clips as discussed above, the rigid connecting means formed thereby serves to retain the associated framework in erected position. Accordingly, the connecting means provides a manually operated means for retaining the framework in erected position which can be quickly and easily assembled or disassembled relative to the framework. The connecting means also serves a second function of providing a means for attaching a display means thereto as set forth below.

A display support means is provided in the form of a single sheet of material 220 including an upper edge 222, a lower edge 224 and a pair of opposite side edges 226 and 228. This sheet of material provides a substantially continuous support surface. The display support means is formed of a material which is adapted to cooperate with the attaching means supported on the clips and the connecting bars so that the display support means may be attached simply by pressing the sheet into engagement with the attaching means and detached by pulling the sheet away from the attaching means. The sheet of material is compatible with and detachably connectible with hook and loop material such as VELCRO. The material of the sheet should be sufficiently flexible so that it can be folded into the configuration shown in FIG. 1, yet it must be sufficiently stiff to support the displayed material. In a typical example, the display support means may comprise a sheet of woven material having loops formed therein. The displays are provided on the back sides thereof with suitable means such as VELCRO and the like which can be readily attached to and detached from the display support means.

It will be noted that the upper edge portion of the sheet of material is attached to the attaching means on connecting bars 200 and 204 as well as the attaching means on the associated clips. In a similar manner, the lower edge portion of the sheet is attached to the attaching means on connecting bars 202 and 206 as well as the attaching means on the associated clips. The sheet of material thereby covers one face of each of the modules 10 and 12.

The sheet of material has opposite end portions thereon curving around the opposite ends of the apparatus with one end portion adjacent side edge 226 attached to the attaching means on connecting bar 198 and the attaching means on the associated clips. The other end portion of the sheet adjacent side edge 228 is attached to the attaching means on connecting bar 196 and the attaching means on the associated clips. In this manner, the display support means presents a large continuous and seamless display surface which covers the faces and ends of the modules so that the framework cannot be seen by a viewer positioned in front of the apparatus. It will be noted that the connecting means is attached to edge portions of the display support means and is also attached to connecting bars 190, 192 and 194 at spaced parts of the display support means intermediate the edge portions thereof.

The display support means may also comprise a single laminated sheet including a first layer of flexible plastic material such as polyvinyl chrloride and a second layer of material which is compatible with and detachably connectible with hook and loop material, the second layer having one face thereof united with a face of the first layer in a conventional manner. When such an arrangement is used, the length and width of the second layer of material are slightly greater than the length and width of the first layer so that the upper and lower edge portions as well as the opposite end edges portions of the second layer of material can be folded over the corresponding edges of the first layer of material so as to lie along and be united with the opposite face of the first layer of material. These folded over portions of the second layer of material provide means for attaching the laminated sheet to the attaching means on connecting bars 196, 198, 200, 202, 204 and 206 as well as the associated clips.

The opposite face of the first layer of material may also be provided with spaced attaching means in the form of strips suitably bonded to such opposite face, each of these strips having outwardly facing material thereon such as VELCRO which is adapted to cooperate with the attaching means on the connecting bars for additionally securing the laminated sheet at intermdiate parts thereof. These strips would be of a length and spacing so as to cooperate with connecting bars 190, 192 and 194 when the display support means is mounted in operative position.

An auxiliary device in the form of illuminating means is provided. The illuminating means includes an elongated tubular support member 230 formed of metal and having an electric cord 232 extending therethrough and connected to a conventional incandescent lamp within a metallic housing 234. The housing is connected to a support member 236 the position of which is adjustable along the length of the support and which may also be adjusted circumferentially about the support so that the lamp may be directed in various directions at the display support means. This type of illuminating means is available zcommercially from Spectralite 70 Ltd. and is identified as lamp type R max.

As seen in FIG. 4, the auxiliary device has mounting portions including a first mounting member 240 fixed as by welding o support 230, member 240 including a part 242 extending at right angles therefrom and received within a hole 244 formed in hub 24 which is identical in construction to hub 26 as previously described. A second mounting member 246 includes a part 248 extending at right angles therefrom and received within the hole defined in the upper portion of hub 26. The illuminating means is thereby securely supported at the top of the apparatus in a most simple and effective manner. The inherent resiliency of the framework enables the hubs 26 and 28 to be forced toward one another a sufficient amount to clear the parts 242 and 248 of the two mounting members allowing these parts to enter into the holes in the hubs, whereupon the framework will return to the position shown in FIG. 4 which prevents the mounting members from escaping from the slots in hubs 26 and 28. Hubs 26 and 28 are thereby prevented from moving away from one another so that the framework is retained in erected position.

Referring now to FIG. 7, a modified clip 130' is provided, this clip being similar to clip 130 and having the same parts provided with the same reference numerals primed. Connecting bar 200 is illustrated as being interconnected with the clip. Clip 130' is provided with an additional pair of ears 250 and 52 having a further pivot pin 254 extending therebetween and spaced from the adjacent side of the clip. This fourth pivot pin may be used to interconnect a further connecting means to the clip in those cases when it is desired to provide further modules in addition to the two modules illustrated.

This modified clip may also be utilized to support the auxiliary illuminating means. If all of the hubs including hubs 24 and 26 are of a construction according to U.S. Pat. No. 4,280,521, clip 130' may be substituted for clip 130 as seen in FIG. 4, and the space between pin 254 and the adjacent side of the clip serves as a hole adapted to receive the part 248 of mounting member 246. In this arrangement a further clip identical to clip 130' would be secured to hub 24 with the part 242 of mounting member 240 being received in the space between the uppermost pivot pin and the adjacent side of the clip. The further clip would be inserted from the right side of hub 24 in the same manner in which clip 130 is shown as inserted from the right side of hub 26. This arrangement would ensure proper spacing between the clips to receive the parts 242 and 248 of the mounting members.

What is claimed is:

1. A collapsible display apparatus comprising a collapsible framework movable between a collapsed compact position and an erected expanded position, said framework including a plurality of interconnected strut means, a plurality of hub means pivotally interconnected with said strut means, said framework in the erected position defining opposite faces and opposite ends of the apparatus, and display support means mounted on said framework so as to substantially cover one of said faces, said display support means defining a substantially continuous support surface to which displays may be attached.

2. Apparatus as defined in claim 1 wherein said display support means comprises a single sheet of material to which a display may be attached by pressing the display into engagement with the support surface and detached by pulling the display away from the support surface.

3. Apparatus as defined in claim 2 wherein said sheet of material is formed of fabric having loops formed therein.

4. Apparatus as defined in claim 1 wherein said display support means comprises a laminated sheet including a first layer of flexible plastic material and a second layer of material which is compatible with and detachably connectible with a hook and loop material.

5. Apparatus as defined in claim 4 wherein said first layer of material has opposite faces, one of said faces being united with said second layer of material, the other of said faces having spaced attaching means thereon for mounting the sheet on said framework.

6. Apparatus as defined in claim wherein said display support means also substantially covers each of the ends of the apparatus.

7. Apparatus ad defined in claim 6 wherein said display support means has opposite edges which are supported adjacent the other of said faces.

8. Apparatus as defined in claim 1 wherein said hub means includes mounting means for mounting an auxiliary device on said framework.

9. Apparatus as defined in claim 1 wherein said hub means includes holes formed therein for mounting an auxiliary device, and an auxiliary device including mounting means disposed within said holes.

10. A collapsible display apparatus comprising a plurality of adjacent collapsible modules defining a collapsible framework movable between a collapsed compact position and an erected expanded position, each of said modules including a plurality of interconnected strut means, a plurality of hub means pivotally interconnected with said strut means of each module, said framework in the erected position defining opposite faces and opposite ends of the apparatus, said modules including connecting means extending between and being detachably interconnected with a pair of hub means of the associated module, attaching means associated with said connecting means for attaching a display means thereto and holding the display means in operative position relative to said modules, and a display support means detachably connected to said attaching means so as to substantially cover one of said faces, said display support means defining a substantially continuous support surface to which displays may be attached.

11. Apparatus as defined in claim 10 including a plurality of clip means, securing means for detachably securing each of said clip means to one of said hub means, said connecting means having opposite end portions, each of said end portions being detachably interconnected with one of said clip means.

12. Apparatus as defined in claim 11 wherein each clip means includes a side and a pivot pin means spaced from said side, said connecting means having a recessed portion formed in each end portion thereof for receiving the pivot pin means of an associated clip means to provide a pivotal interconnection between said clip means and said connecting means.

13. Apparatus as defined in claim 12 wherein each of said recessed portions comprises a groove including a seat portion for snugly receiving said pivot pin means and a reduced entrance portion to hold the pin means in said seat portion.

14. Apparatus as defined in claim 11 wherein said clip means includes attaching means thereon for attaching a display support means thereto.

15. Apparatus as defined in claim 10 wherein said hub means includes mounting means for mounting an auxiliary device on said framework.

16. Apparatus as defined in claim 15 wherein said hub means includes holes formed therein for mounting an auxiliary device, and an auxiliary device including mounting means disposed within said holes.

17. Apparatus as defined in claim 11 wherein at least one of said clip means has a plurality of sides and means on at least two of said sides for detachably securing said connecting means thereto.

18. Apparatus as defined in claim 17 including means on a third side of said one clip means for detachably securing said connecting means thereto.

19. Apparatus as defined in claim 18 including means on a fourth side of said one clip means for detachably securing said connecting means thereto.

20. Apparatus as defined in claim 10 wherein said connecting means is attached to edge portions of said display support means.

21. Apparatus as defined in claim 20 wherein said connecting means is also attached to spaced parts of said display support means intermediate said edge portions.

22. Apparatus as defined in claim 10 wherein said connecting means is disposed along peripheral portions of said modules and is attached to edge portions of said display support means.

23. A collapsible display apparatus comprising a collapsible framework including a plurality of pivotally interconnected strut means foldable into substantially parallel relationship to one another, a plurality of hub means pivotally interconnected with said strut means, display support means mounted on said framework, mounting means on said hub means for mounting an auxiliary device, and an auxiliary device including mounting portions cooperating with said mounting means for holding the auxiliary device in mounted position and preventing movement of the associated hub means away from one another.

24. Apparatus as defined in claim 23 wherein said mounting means on said hub means comprises holes formed in said hub means, said mounting portions including parts thereof disposed within said holes.

25. Apparatus as defined in claim 24 wherein said auxiliary device includes a support member, said mounting portions including a first mounting member fixed to said support member and a second mounting member fixed to said support member and spaced from said first mounting member.

26. Apparatus as defined in claim 25 wherein said mounting members each includes a part disposed within said holes, said parts extending toward one another from the associated mounting members.

27. Apparatus as defined in claim 23 wherein said mounting means includes a clip means connected to an associated hub, said clip means including a portion spaced from one side thereof to define a hole for receiving one of said mounting portions.

28. A collapsible display apparatus comprising a plurality of adjacent modules, each of said modules including a plurality of pivotally interconnected strut means and hub means, said modules including a plurality of common strut means and hub means, said modules being movable between a collapsed compact position wherein said strut means are substantially parallel to one another and certain ones of said hubs means are disposed adjacent one another and an erected expanded position wherein said certain ones of said hub means are disposed in spaced relation to one another with said certain ones of said hub means of each module lying in a substantially planar rectangular array, a plurality of rigid connecting means, each of said connecting means extending between and being detachably connected to a pair of said certain ones of said hub means of each of said modules for retaining said modules in erected position, display support means mounted on said framework, and mounting means on said hub means for mounting an auxiliary device, and an auxiliary device including mounting portions cooperating with said mounting means for holding the auxiliary device in mounted position and preventing movement of the associated hub means away from one another.

29. Apparatus as defined in claim 28 wherein said mounting means on said hub means comprises holes formed in said hub means, said mounting portions including parts thereof disposed within said holes.

30. Apparatus as defined in claim 29 wherein said auxiliary device includes a support member, said mounting portions including a first mounting member fixed to said support member and a second mounting member fixed to said support member and spaced from said first mounting member.

31. Apparatus as defined in claim 30 wherein said mounting members each include a part disposed within said holes, said parts extending toward one another from the associated mounting members.

32. Apparatus as defined in claim 28 wherein said mounting means includes a clip means connected to an associated hub, said clip means including a portion spaced from one side thereof to define a hole for receiving one of said mounting portions.

33. A collapsible display apparatus comprising a plurality of adjacent modules, each of said modules including a plurality of pivotally interconnected strut means and hub means, said modules including a plurality of common strut means and hub means, said modules being movable between a collapsed compact position wherein said strut means are substantially parallel to one another and certain ones of said hubs means are disposed adjacent one another and an erected expanded position wherein said certain ones of said hub means are disposed in spaced relation to one another with said certain ones of said hub means of each module lying in a substantially planar rectangular array, said modules in the erected position defining opposite faces and opposite ends of the apparatus, a plurality of rigid connecting means, each of said connecting means extending between and being detachably connected to a pair of said certain ones of said hub means for retaining said modules in erected position, and display support means mounted on said modules so as to substantially cover one of said faces, said display support means defining a substantially continuous support surface to which displays may be attached, said surface being compatible with a hook and loop material.

34. Apparatus as defined in claim 33 wherein said display support means also substantially covers each of the ends of the apparatus.

35. Apparatus as defined in claim 34 wherein said display support means has opposite edges which are supported adjacent the other of said faces.

36. Apparatus as defined in claim 33 wherein said display support means comprises a laminated sheet including a first layer of flexible plastic material and a second layer of material which is compatible with and detachably connectible with hook and loop material.

37. Apparatus as defined in claim 36 wherein said first layer of material has opposite faces, one of said faces being united with said second layer of material, the other of said faces having spaced attaching means thereon for mounting the sheet to said framework.

38. A collapsible display apparatus comprising a plurality of adjacent modules, each of said modules including a plurality of pivotally interconnected strut means and hub means, said modules including a plurality of common strut means and hub means, said modules being movable between a collapsed compact position wherein said strut means are substantially parallel to one another and certain ones of said hubs means are disposed adjacent one another and an erected expanded position wherein said certain ones of said hub means are disposed in spaced relation to one another with said certain ones of said hub means of each module lying in a substantially planar rectangular array, said modules in the erected position defining opposite faces and opposite ends of the apparatus, a plurality of rigid connecting means, each of said connecting means extending between and being detachably connected to a pair of said certain ones of said hub means for retaining said modules in erected position, display support means mounted on said modules so as to substantially cover one of said faces, said display support means defining a substantially continuous support surface to which displays may be attached, and mounting means on said hub means for mounting an auxiliary device, and an auxiliary device including mounting portions cooperating with said mounting means for holding the auxiliary device in mounted position and preventing movement of the associated hubs away from one another.

39. A collapsible display apparatus comprising a plurality of adjacent modules interconnected with one another, each of said modules including a plurality of pivotally interconnected strut means and hub means, said modules being movable between a compact collapsed position and an erected expanded position, said modules in the collapsed position having certain ones of said hubs disposed adjacent one another and said strut means disposed substantially parallel to one another to define a bundle having a lengthwise dimension slightly greater than the length of one of said strut means, said modules in the erected expanded position having said certain ones of said hub means disposed in spaced relation to one another with said certain ones of said hub means of each modules lying in a substantially planar rectangular array, said modules in the erected expanded position defining an apparatus having a dimension of one module in a first direction and a dimension of a plurality of modules in a second direction, said modules in the erected position defining opposite faces and opposite ends of the apparatus, and display support means mounted on said modules so as to substantially cover one of said faces, said display support means defining a substantially continuous support surface to which displays may be attached, said display support means having a dimension in a first direction of approximately one erected module of the apparatus and having a substantially greater dimension in a second direction.

* * * * *